US007385140B2

(12) United States Patent
Ishizaki et al.

(10) Patent No.: US 7,385,140 B2
(45) Date of Patent: Jun. 10, 2008

(54) GROUNDING CONDUCTOR

(75) Inventors: Makoto Ishizaki, Tokyo (JP); Minoru Yoneda, Tokyo (JP); Junichi Takabe, Tokyo (JP)

(73) Assignee: Sankosha Corporation, Tokyo (JP)

( * ) Notice: Subject to any disclaimer, the term of this patent is extended or adjusted under 35 U.S.C. 154(b) by 0 days.

(21) Appl. No.: 11/155,496

(22) Filed: Jun. 20, 2005

(65) Prior Publication Data

US 2005/0279525 A1 Dec. 22, 2005

(30) Foreign Application Priority Data

Jun. 21, 2004 (JP) ..... 2004-182017

(51) Int. Cl.
*H01B 7/18* (2006.01)

(52) U.S. Cl. ..... 174/102 SC; 174/6

(58) Field of Classification Search ..... 174/102 SC, 174/115, 6

See application file for complete search history.

(56) References Cited

U.S. PATENT DOCUMENTS

| | | | | | |
|---|---|---|---|---|---|
| 1,938,308 | A * | 12/1933 | Wiegand | 428/368 |
| 3,297,814 | A * | 1/1967 | McClean et al. | 174/41 |
| 4,227,034 | A | 10/1980 | van Rijswijck | |
| 4,361,723 | A * | 11/1982 | Hvizd et al. | 174/102 SC |
| 4,503,284 | A * | 3/1985 | Minnick et al. | 174/36 |
| 4,540,845 | A | 9/1985 | Frola | |
| 4,577,053 | A | 3/1986 | Kies | |
| 4,994,629 | A * | 2/1991 | Tatum et al. | 174/6 |
| 5,418,330 | A * | 5/1995 | Rook | 174/78 |
| 5,608,186 | A | 3/1997 | Collins, Jr. et al. | |
| 6,271,466 | B1 * | 8/2001 | Tsuneoka et al. | 174/36 |
| 6,422,900 | B1 * | 7/2002 | Hogan | 439/578 |
| 2002/0153157 | A1 * | 10/2002 | Harger et al. | 174/78 |

FOREIGN PATENT DOCUMENTS

| | | | |
|---|---|---|---|
| EP | 784327 | * | 7/1997 |
| JP | 59-211975 | | 11/1984 |
| WO | 97/13890 | | 4/1997 |

* cited by examiner

*Primary Examiner*—Chau N Nguyen
(74) *Attorney, Agent, or Firm*—Westerman, Hattori, Daniels & Adrian, LLP.

(57) ABSTRACT

A grounding conductor 1 is composed of a conductive metal portion 2 and a conductive casing portion 3 that covers the conductive metal portion 2. The conductive casing portion 3 has a specific resistance of 0.01 to 0. (Ω·m). Since the grounding conductor 1 is composed of the conductive metal portion 2 and the conductive casing portion 3 that covers the conductive metal portion 2, the conductive metal portion 2 is connected to the earth via the conductive casing portion 3. The conductive metal portion 2 does not contact directly with the earth but is electrically connected to the earth via the conductive casing portion 3.

This prevents the conductive metal portion 2 from being corroded. It is also possible to avoid a disconnection in the conductive metal portion 2.

8 Claims, 2 Drawing Sheets

GROUNDING CONDUCTOR

FIELD OF THE INVENTION

The present invention relates to a grounding conductor constituting grounding device installed in the ground.

BACKGROUND OF THE INVENTION

A bare copper material is conventionally used as a grounding conductor constituting a grounding device. Bare copper materials serving as grounding conductors are arranged in a trench dug in the earth to a predetermined depth, and the copper materials are arranged in a grid pattern in a vertical and horizontal directions. This constitutes a mesh electrode. By way of example, a grounding device having such a mesh electrode is disclosed in the Unexamined Japanese Patent Application Publication (Tokkai-Sho) No. 59-211975.

However, with the conventional grounding device employing metal conductors such as bare copper materials as grounding conductors constituting a mesh electrode as described above, the grounding conductors comprising bare metal conductors are arranged directly in the earth. Accordingly, the corrosion of the grounding conductors comprising bare metal conductors is facilitated by moisture in the soil, the acidity of the soil, the concentration of salt in the soil, and the like. Thus, disadvantageously, the grounding conductors installed in the earth may be subjected to a disconnection or the like, thus spoiling the grounding function of the grounding device.

If the grounding conductors comprising bare metal conductors are covered with a grounding resistance reducing material comprising carbon and cement, the disconnection or the like caused by the corrosion attributed to the soil is unlikely to occur compared to grounding conductors arranged directly in the earth.

These grounding conductors also have a long lifetime. However, the specific resistance of the soil changes rapidly in areas in which the grounding conductors comprising bare metal conductors are not completely covered with the grounding resistance reducing material and in areas in which leaders extend from the ground conductors, and the carbon is very unlikely to be ionized. Consequently, in an electrolytic state such as the one in the soil, contact with the carbon causes the grounding conductors comprising bare metal conductors to be corroded by a battery action resulting from a difference in potential (what is called galvanic corrosion). Disadvantageously, this may cause the disconnection or the like.

Moreover, it has been found that the corrosion is facilitated in areas of the earth in which a direct current is flowing. This is another problem with the conventional grounding conductors comprising bare metal conductors.

It is an object of the present invention to solve the above problems with the conventional grounding conductors.

SUMMARY OF THE INVENTION

To accomplish the above object, the preset invention provides a grounding conductor described below. First, the grounding conductor comprises a conductive metal portion and a conductive casing portion that covers the conductive metal portion, and the conductive casing portion has a specific resistance of 0.01 to 10 (Ω·m). Second, an identification projection is formed on an outer peripheral surface of the conductive casing portion along a longitudinal direction of the grounding conductor. Third, the conductive metal portion is constructed by twisting conductive metal solid wires comprising copper wires together, and tinned plated coating is formed on the conductive metal solid wires.

The present invention has the above configuration and can thus produce the effects described below.

The grounding conductor comprises the conductive metal portion and the conductive casing portion that covers the conductive metal portion. Accordingly, the conductive metal portion is connected to the earth via the conductive casing portion, and the conductive metal portion does not contact directly with the earth but is electrically connected to the earth via the conductive casing portion. This makes it possible to prevent the conductive metal portion from being corroded. Therefore, for example, an disconnection or the like in the conductive metal portion can be avoided. Furthermore, the conductive casing portion has a specific resistance of 0.01 to 10 (Ω·m). This specific resistance (electrical resistivity) is low and substantially equal to or less than that of the earth. Consequently, grounding can be accomplished with a low specific resistance (electrical resistivity).

The identification projection is formed on the outer peripheral surface of the conductive casing portion along the longitudinal direction of the grounding conductor. Accordingly, the grounding conductor can be definitely distinguished from other electric wires or the like. This makes it possible to prevent the conductive casing portion from being mistaken for other electric wires or the like.

The conductive metal portion is constructed by twisting conductive metal solid wires comprising copper wires, and tinned plated coating is formed on the conductive metal solid wires. This further improves the corrosion resistance performance of the conductive metal solid wires. Therefore, the present invention improves the reliability in the prevention of a disconnection in the conductive metal solid wires as well as the reliability of the grounding device.

DETAILED DESCRIPTION OF THE PREFERRED EMBODIMENTS

Figure 1:
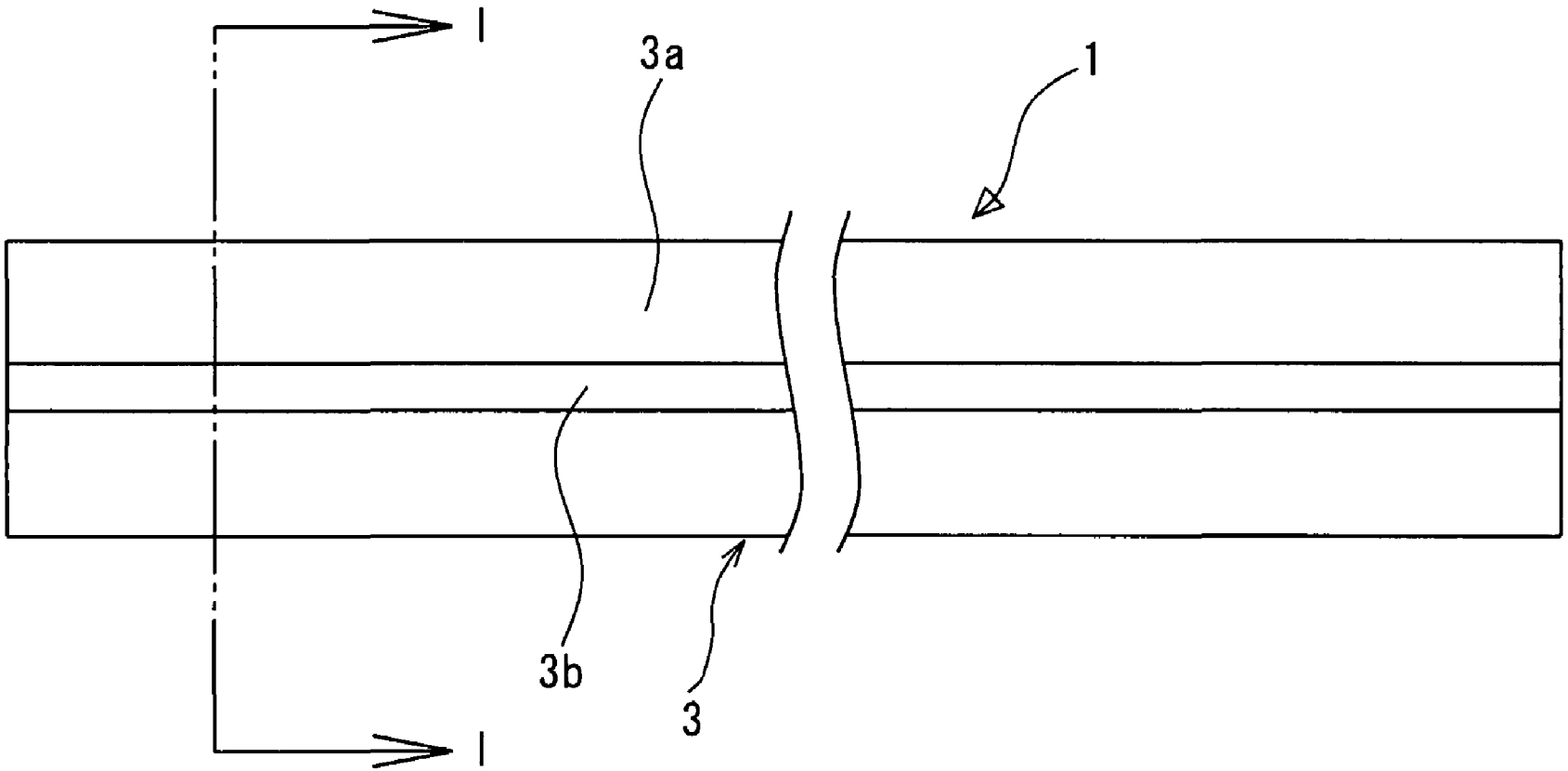
FIG. 1 is a front view of a grounding conductor according to the present invention.
Figure 2:
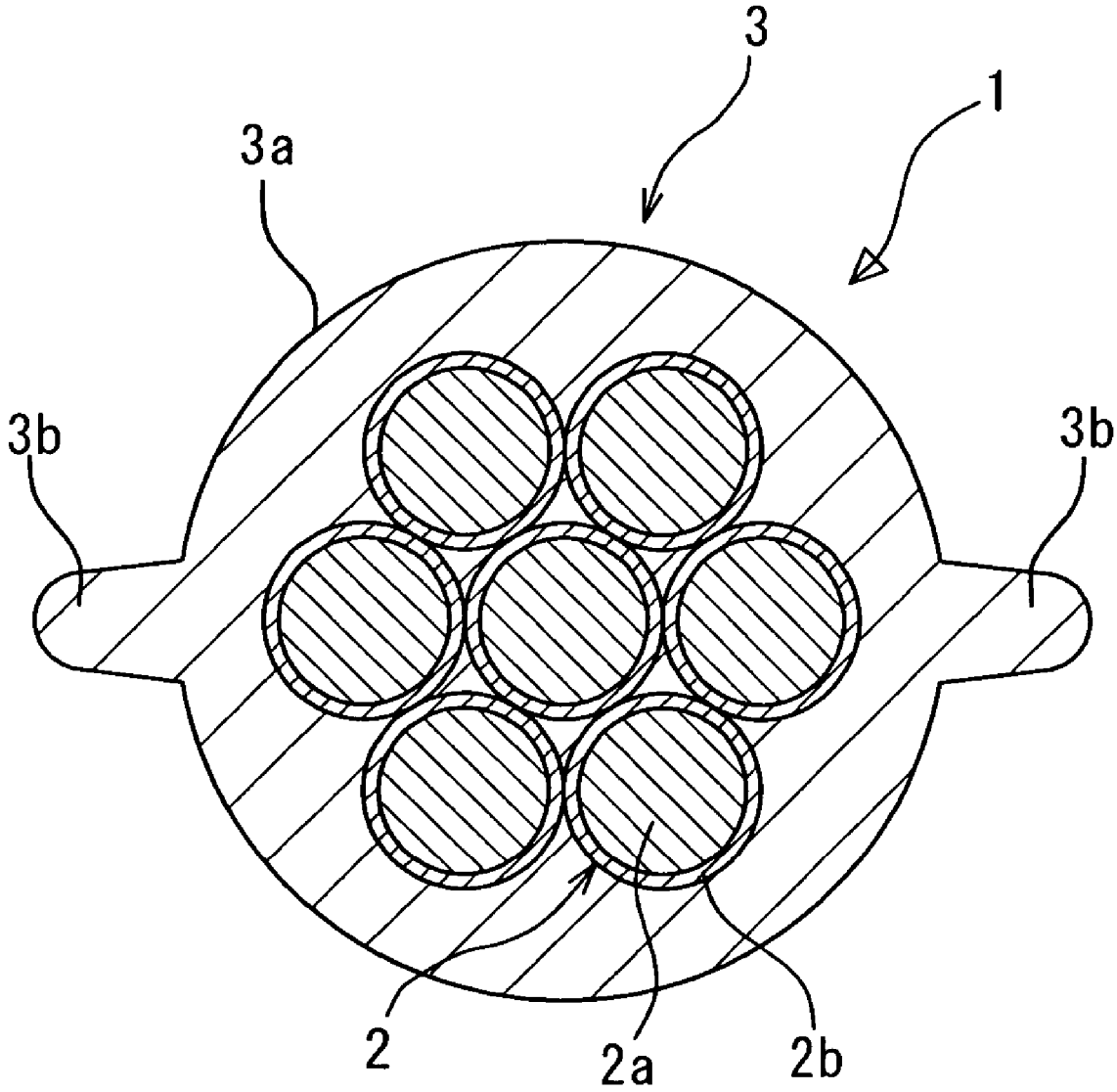
FIG. 2 is a side sectional view of the grounding conductor according to the present invention taken along line 1-1 in FIG. 1.

An embodiment of the present invention will be described below. However, the present invention is not limited to the embodiment without departing from its spirit.

1 is a grounding conductor. The grounding conductor 1 is composed of a conductive metal portion 2 located in a central portion of the grounding conductor 1 and a conductive casing portion 3 located around the outer periphery of the conductive metal portion 2.

The conductive metal portion 2 constituting the grounding conductor 1 is formed by twisting a plurality of conductive metal solid wires 2*a* together. By way of example, the conductive metal solid wires 2*a* may be copper wires. Further, each conductive metal solid wire 2*a* comprising a copper wire is preferably tinned to form a tinned plated coating 2*b* on the conductive metal solid wire 2*a*.

The conductive casing portion 3 constituting the grounding conductor 1 is composed of a conductive resin obtained by mixing any of various polymers such as polyvinyl chloride and polyacetylene or rubber with conductive carbon black powder or conductive metal powder.

A suitable conductive carbon black mixed into the polymer, rubber, or the like is an acetylene black, a furnace black, a Ketien Black, or the like. The conductive metal powder provides a higher conductivity than the conductive carbon black. However, the conductive metal powder has a high specific gravity and has an insufficient fluidity when the resin is molded. Further, undesirably, the grounding conductor 1 molded has an increased weight and further has a degraded quality and an increased price. Therefore, the carbon black is preferably used. In the embodiment described below, the conductive carbon black powder is used.

An extruder or the like is supplied with a mixture of a chip of the polymer or rubber, or the like which is an insulator and the conductive carbon black powder. Thus, a mixed pellet of the polymer or rubber and the conductive carbon black powder is molded. The mixed pellet thus formed is supplied to a molding machine to coat the periphery of the conductive metal portion 2 with the mixed pellet melted. Thus, the grounding conductor 1 is molded in which the conductive metal portion 2 is covered with the conductive casing portion 3.

The specific resistance (electrical resistivity) of the conductive casing portion 3 is set at 0.01 to 10 (Ω·m) by appropriately adjusting the compounding ratio of the conductive carbon black powder to the polymer, rubber, or the like. In view only of the electrical characteristics of the grounding conductor 1, a lower specific resistance (electrical resistivity) is preferable. Ideally, a specific resistance of 0 (Ω·m) is preferred. However, to decrease the specific resistance (electrical resistivity), it is necessary to increase the amount of conductive carbon black powder, that is, the compunding ratio of the conductive carbon black powder to the polymer, rubber, or the like. However, an increase in the compounding ratio the conductive carbon black powder to the polymer, rubber, or the like may lower the fluidity of the molten resin such as the polymer or resin which is mixed with the conductive carbon black powder. In this case, the resilience, rigidity, or the like of the conductive casing portion 3 may also be dropped. The drop in the fluidity of the molten resin such as the polymer or resin which is mixed with the conductive carbon black powder may make the conductive casing portion 3 difficult to mold. Further, the conductive casing portion 3 may be subjected to cracking, distortion, or the like. This is not preferable in terms of quality. Furthermore, the degradation of the resilience, rigidity, or the like of the conductive casing portion 3 makes the conductive casing portion 3 likely to be cracked when the grounding conductor 1 is bent, and the conductive casing portion 3 may also be damaged under an external pressure or the like.

When the conductive casing portion 3 has a specific resistance (electrical resistivity) of less than 0.01 (Ω·m), the compounding ratio of the conductive carbon black powder to the polymer, rubber, or the like becomes too high. As a result, when the grounding conductor 1 is manufactured, there may undesirably be a drop in the fluidity of the mixed molten resin or the resilience, rigidity, or the like of the conductive casing portion 3 constituting the grounding conductor 1 molded. Further, when the conductive casing portion 3 has a specific resistance (electrical resistivity) of more than 10 (Ω·m), the electrical characteristics of the grounding conductor 1 is degraded and thus the grounding performance of the grounding device may be degraded.

It has been found that the following measures is appropriate for preventing the conductive casing portion 3 from being damaged while the grounding conductor 1 remains stored or is being installed or used, and the polymer, rubber, or the like is mixed with the conductive carbon black powder so that the conductive casing portion 3 has a specific resistance (electrical resistivity) of 0.01 to 10 (Ω·m).

**3*b* is an identification projection formed on an outer peripheral surface 3*a* of the conductive casing portion 3 constituting the grounding conductor 1 and along a longitudinal direction of the grounding conductor 1. In the present embodiment, two identification projections 3*b* are formed at positions separated by 180 degrees in a cross section perpendicular to a longitudinal direction of the grounding conductor 1. The identification projections 3*b* are used for identification, that is, they allow the grounding conductor 1 with the conductive casing portion 3** to be easily distinguished from other electric wires or the like.

As described above, the grounding conductor 1 is covered with the conductive casing portion 3, which is conductive. Accordingly, the conductive metal portion 2 contacts with the earth via the conductive casing portion 3, and the conductive metal portion 2 and the earth do not contact directly with each other. Further, the conductive metal portion 2 is entirely covered with the conductive casing portion 3. Consequently, the conductive metal portion 2 is completely shielded from moisture or the like in the earth while being electrically connected with the earth. This avoids disconnection accidents caused by corrosion or the like.

Further, as described above, the mixture of the polymer, rubber, or the like and the conductive carbon black powder or conductive metal powder, which constitute the conductive casing portion 3, is set so that the conductive casing portion 3 has a specific resistance (electrical resistivity) of 0.01 to 10 (Ω·m). This reduces the grounding resistance and prevents the conductive casing portion 3 from being cracked or damaged.

Moreover, the identification projections **3*b* are projected from the conductive casing portion 3. Consequently, the conductive casing portion 3 can be definitely distinguished from other electric wires or the like. This makes it possible to prevent the conductive casing portion 3** from being mistaken for other electric wires or the like.

Moreover, by forming a tinned plated coating **2*b* on the conductive metal solid wire 2*a* constituting the conductive metal portion 2, it is possible to further improve the corrosion resistant performance of the conductive metal solid wire 2*a*. This enhances the reliability in the prevention of a disconnection in the conductive metal solid wire 2*a***.

Furthermore, the conductive carbon black powder or conductive metal powder is appropriately mixed with the polymer, rubber, or the like and so that the conductive casing portion 3 has a specific resistance (electrical resistivity) of 0.01 to 10 (Ω·m). Consequently, the conductive casing portion 3 has an appropriate resilience. Therefore, the conductive casing portion 3 can be wound around a drum or the like and them stored or transported without being subjected to cracking, damage, or the like. This allows the grounding conductor 1 to be easily and efficiently handled and facilitates the operation of installing the grounding device. For example, 100 to 500 meters of grounding conductor 1 is wound around one drum or the like.

The conductive metal powder may be gold, silver, aluminum, stainless steel, nickel or the like, and these metals may be made fibrous. The conductive metal powder provides a high conductivity but is expensive and has a high specific gravity. It is also difficult to process the conductive metal powder. Thus, the conductive metal powder is inferior to the carbon black but an appropriate amount of conductive metal powder may be added to the carbon black.

The invention claimed is:

1. A grounding conductor characterized by comprising a conductive metal portion and a conductive casing portion that covers and contacts the conductive metal portion, the conductive casing portion having a specific resistance of 0.01 to 10 Ω.m;

wherein said conductive casing portion is located at the outer most peripheral portion of said grounding conductor;

wherein the entire outer surface of said conductive casing portion is in complete electrical contact with earth ground; and wherein said conductive casing portion is not surrounded by an outer sheath;

wherein said grounding conductor is flexible so that it may be wound around a drum.

2. A grounding conductor according to claim 1, characterized in that an identification projection is formed on an outer peripheral surface of the conductive casing portion along a longitudinal direction of the grounding conductor.

3. A grounding conductor according to claim 1 or claim 2, characterized in that the conductive metal portion is constructed by twisting conductive metal solid wires comprising copper wires together, and tinned plated coating is formed on the conductive metal solid wires.

4. A grounding conductor characterized by comprising a conductive metal portion and a conductive casing portion that covers and contacts the conductive metal portion, the conductive casing portion having a specific resistance of 0.01 to 10 Ω.m and an identification projection formed on an outer peripheral surface of the conductive casing portion along a longitudinal direction of the grounding conductor;

wherein the entire outer surface of said conductive casing portion, including said identification projection, is in complete electrical contact with earth ground; and wherein said conductive casing portion, including said identification projection, is not surrounded by an outer sheath.

5. A grounding conductor according to claim 4, characterized in that the conductive metal portion is constructed by twisting conductive metal solid wires comprising copper wires together, and tinned plated coating is formed on the conductive metal solid wires.

6. A grounding conductor characterized by comprising a conductive metal portion and a conductive casing portion that covers and contacts the conductive metal portion, the conductive casing portion having a specific resistance of 0.01 to 10 Ω.m;

wherein said conductive casing portion is located at the outer most peripheral portion of said grounding conductor;

wherein said conductive casing portion discharges electrical charges directly to earth;

wherein said grounding conductor is flexible so that it may be wound around a drum.

7. A grounding conductor according to claim 6, characterized in that an identification projection is formed on an outer peripheral surface of the conductive casing portion along a longitudinal direction of the grounding conductor.

8. A grounding conductor according to claim 6, characterized in that the conductive metal portion is constructed by twisting conductive metal solid wires comprising copper wires together, and tinned plated coating is formed on the conductive metal solid wires.

* * * * *